US006334283B1

(12) United States Patent
Edger

(10) Patent No.: US 6,334,283 B1
(45) Date of Patent: Jan. 1, 2002

(54) WATER RESISTANT WINDOW FRAME

(75) Inventor: Ronald Fredrick Edger, Woodbrige (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 09/666,079

(22) Filed: Sep. 21, 2000

(30) Foreign Application Priority Data

Sep. 21, 1999 (CA) ..... 2282988

(51) Int. Cl.[7] ..... E06B 1/04

(52) U.S. Cl. ..... 52/204.1; 52/97; 52/656.5; 52/209

(58) Field of Search ..... 52/204.1, 656.5, 52/97, 656.6, 209, 204.55; 49/408

(56) References Cited

U.S. PATENT DOCUMENTS 932,190 A * 8/1909 Thorne ..... 52/97

FOREIGN PATENT DOCUMENTS

DE WO-94/25717 * 11/1994 ..... 52/204.1
JP 406248779 A * 9/1994 ..... 52/204.1

* cited by examiner

*Primary Examiner*—Carl D. Friedman
*Assistant Examiner*—N. Slack

(57) ABSTRACT

A window frame incorporating a sliding sash, the frame providing increased water resistance by incorporating an integral J-rail return, the return portion of which has a double wall to provide a depending trough at the bottom of the frame with a wall forming a chamber including the trough, opening from the bottom of the frame into the chamber and from the bottom of the trough to the exterior to provide increased dam height against water backing up and spilling over the interior sill of the frame.

9 Claims, 2 Drawing Sheets

WATER RESISTANT WINDOW FRAME

FIELD OF THE INVENTION

This invention relates to a window frame construction for receiving and supporting a sliding window sash,, the frame to be mounted in a window opening in a wall of a structure, the window frame incorporating a J-rail return member to overlie siding applied to the exterior of the structure.

More particularly, the invention is directed to such a window frame that provides increased water resistance for a minimized exposed interior sill frame height and hence increased egress opening, the frame also providing increased stiffness or strength, resistance to impact, and reduced costs of material.

BACKGROUND OF THE INVENTION

In the prior art there are many window frames which include a window retaining body portion for insertion into an opening in the wall of a building structure to circumscribe the interior of the opening and a nailing flange or fin circumscribing the exterior of the opening.

Many such window frames also include a J-rail return member or which comprises a nailing fin member, a member projecting outwardly from the nailing fin and a return member connected at the end of the outwardly projecting member. This J-rail return member defines a J-channel to receive the ends of siding or the like with the return portion of the J-rail return member overlying the siding. Such prior art window frames are disclosed in U.S. Pat. No. 2,983,001, issued May 9th, 1961, U.S. Pat. No. 4,694,612, issued Sep. 22nd, 1987, and U.S. Pat. No. 5,392,574, issued Feb. 28th, 1995.

When rain strikes the sliding sash or window unit, particularly when driven against the window unit by a strong wind, the water can penetrate between the sash and frame even with the sash tightly closed to collect under the sash where it drains off through openings at the bottom of the frame. Where the frame includes a J-return rail, the water flows out over the projecting portion of the J-return rail to spill over the end thereof.

The water resistance rating of the window, that is the amount of water forced against the window unit that can accumulate before it spills out over the inside of the sill of the window frame is determined by the height of the inside of the window frame at the window sill above the surface of the bottom of the frame or, in the case where the frame has a J-rail return, above the surface of the projecting portion of the J-rail return. The depth to which the water can accumulate before it spills over the inner edge of the frame is hereinafter referred to as the dam height.

If the inside height of the sill of the frame is increased, the dam height and hence water resistance of the window unit is increased. However, such increase in window frame height reduces the egress opening, that is the size of the opening through which a person can escape in the event of an emergency. In addition, increasing the height of the frame inner sill for increased dam height either by the frame profile itself or increasing the height of the sash retaining snap-in stop increases the amount of material required for the frame and hence the cost of the frame.

SUMMARY OF THE INVENTION

The present invention is directed to increasing the dam height without increasing the interior height of the sill thus providing for increased water resistance for the window unit without reducing the size of the egress opening. Further the invention provides such increased water resistance with minimal increase in material costs while affording increased frame stiffness or strength and resistance to impact.

This increased water resistance or dam height is achieved according to the invention by forming a section of the return portion of the J-rail return member with a double wall to provide a trough at the sill of the frame to receive water spilling over the projecting portion of the J-rail return member, the trough being provided with a discharge opening at the bottom thereof. With this arrangement, the dam height is the distance between the bottom of the trough of the J-rail return member and the inside height of the sill of the frame.

With this arrangement, the dam height increase is obtained without any reduction in the size of the egress opening presented by the frame, with the sash fully open.

Further by providing this double walled section of the return portion of the J-rail return member, the strength of the frame and its resistance to impact is significantly increased.

PRIOR ART FRAME

Figure 1:
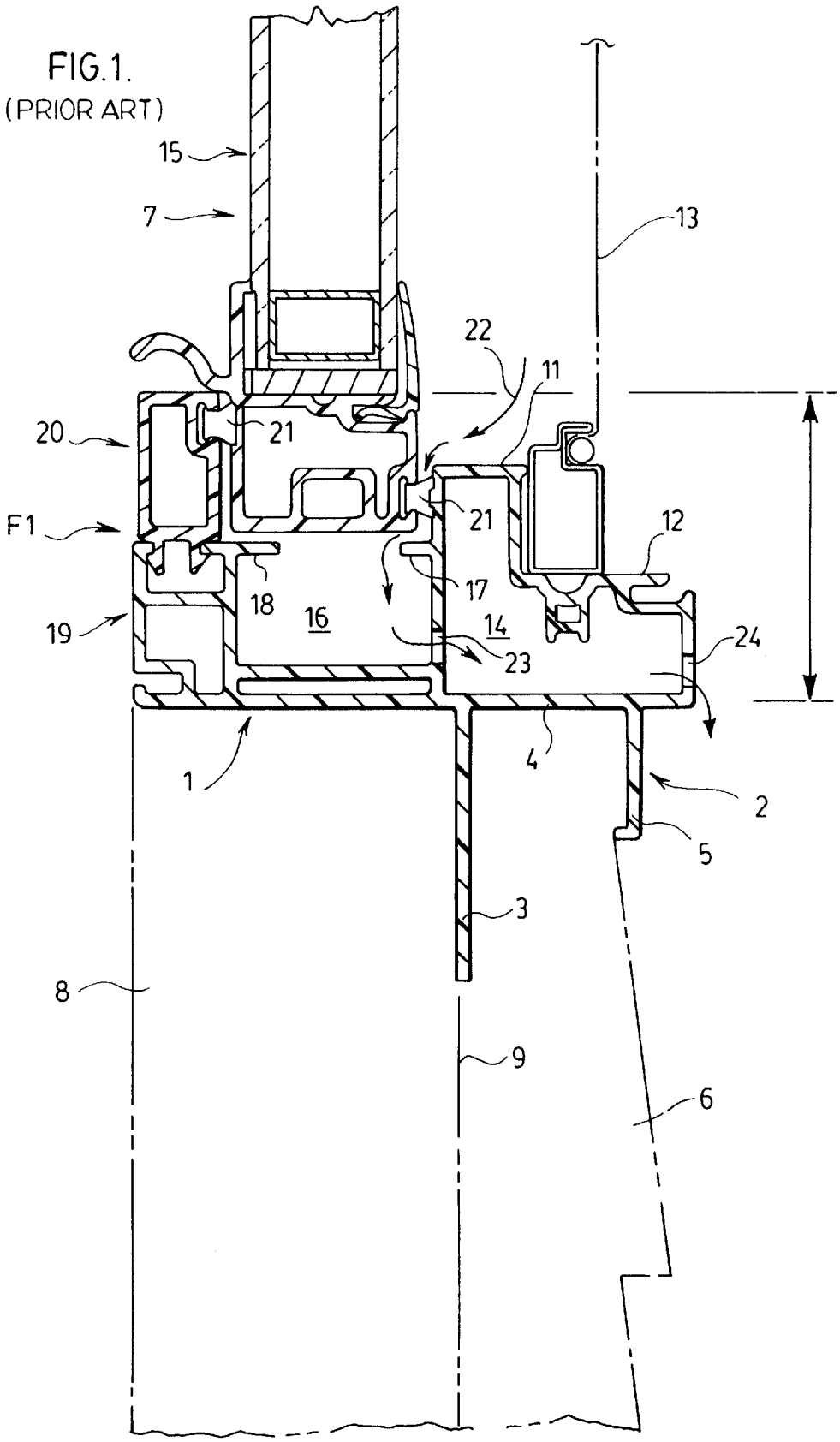
FIG.1. (PRIOR ART)
FIG. 1 is a broken away vertical sectional view through the sill of a prior art window frame having an integral J-rail return member and supporting a slideable window sash and showing the exposed interior height of the frame for a water resisting dam height X.

With respect to the prior art frame, generally designated at F1, FIG. 1, of which only the sill is shown, it will be seen that the body portion 1 is provided with an integral J-rail return member generally designated at 2 which comprises a nailing fin 3 projecting perpendicular to the body portion 1, an outwardly projecting portion 4 and a return portion 5 extending in the same direction as and generally parallel to the nailing fin 3. The purpose of the J-rail return member 3 is to receive and overlap the ends of siding 6.

Although only the sill is shown, it will be understood that the frame F1 will have a rectangular configuration capable of receiving and supporting a slideable window sash with the body portion 1 being adapted to be received in and circumscribe the interior of an opening 7 in the wall 8 of a structure while the nailing fin 3 is adapted to circumscribe the outer face 9 of the wall 8 around the opening 7.

The body portion 1 of the frame as shown at the sill is provided with an outer sash or window stop formation 11 and a support seat 12 for a screen 13 and forms with the projecting portion 4 of the J-rail return member a chamber 14. As mentioned, the frame F1 is adapted to support a sliding window unit or sash 15 for opening and closing the lower half of the window opening, the top half being fixed glazed (not shown).

The body portion 1 of the frame F1 is formed to provide a channel 16 with sash engaging or stop ledges 17 and 18 at the entrance to the channel which at the sill form sash closing stops. At the inner side, the body portion of the frame is provided with a latching section 19 which extends to a point flush with the stop ledges 17 and 18 and this latching section is adapted to receive a snap-in stop 20 to retain the window unit or sash 15. Suitable brush type weather stripping 21 is provided on opposite sides of the window unit to prevent free air flow around the edge of the window unit. However, in heavy rain, particularly when driven against the window unit, the rain water will be forced in the direction of the arrows 22 between the frame stop 11 and the closed sash 15 to accumulate in the channel 16. Channel 16 is provided with an opening 23 to allow for outflow into the chamber 14 over the projecting portion 4 of the J-rail return member 2 and out the chamber outlet 24.

Under sufficiently heavy rain as, for example, represented by tests of turning a hose on the window, the water will accumulate in the channel 16 and chamber 14 until it backs up between the closed sash 15 and the inner stop 20 until it spills over into the interior of the building structure.

The resistance to this spilling over of the water is measured in terms of "dam height". As the dam height is increased, the water resistance of the window is increased.

In FIG. 1, the dam height X of the frame F1 is the distance between the top of the snap-in window stop 20 to the bottom of the chamber 14 where the water is released through the outlet 24. In FIG. 1, this dam height, in effect, is the height of the body portion 1 at the interior of the wall opening 7 plus the height of the stop 20. Thus, the dam height or water resistance of the window is increased as the height of the stop 20 is increased. However, this increases the exposed interior height of the window sill detracting from its appearance and reducing the egress opening, that is the space available for exiting the window in the case of an emergency when the window is fully open. In other words, to increase the water resistance of the window, the egress opening is correspondingly reduced and may require an overall increase in window size, window frame and wall opening to obtain the allowable window egress opening in order to meet the required water resistance.

DETAILED DESCRIPTION ACCORDING TO THE PREFERRED EMBODIMENTS OF THE PRESENT INVENTION

Figure 2:
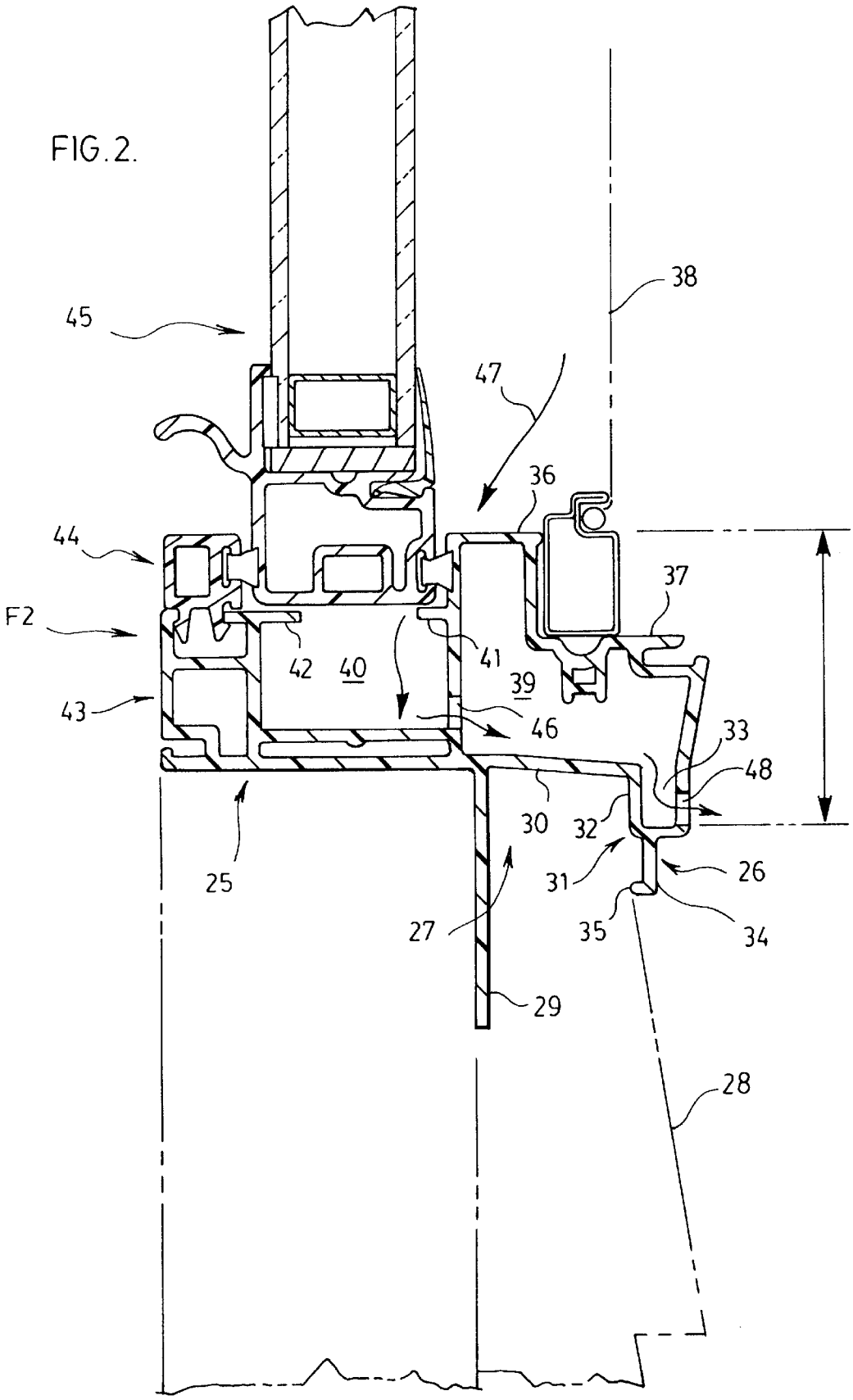
FIG. 2 is a view similar to FIG. 1 through the sill of the window frame embodying the invention showing the reduced exposed interior height of the frame at the sill to obtain the same water resisting dam height X.

FIG. 2 illustrates a window frame unit designated as F2 which achieves the desired water resistance represented by the dam height X while reducing the exposed interior height at the sill of the window frame thus increasing the size of the egress opening and increasing the aesthetic appearance of the window interior.

FIG. 2 is a view similar to FIG. 1 but showing a section through the sill of the frame F2 which has been modified to incorporate the invention. Frame F2 has a body portion 25 corresponding to the body portion 1 of the frame F1. The body portion 25 carries an integral J-rail return member designated at 26 which is modified from the J-rail return 2 of FIG. 1 but does provide a J-channel 27 for receiving siding 28.

The J-rail return 26 comprises a nailing fin or flange 29 portion corresponding to the nailing fin 3 in FIG. 1, an outwardly projecting arm or portion 30 and a return portion generally designated at 31. This return portion 31 comprises a double walled section 32 forming a channel or trough 33 and a single leg 34 projecting from the bottom of the trough 33 and ending in an inturned bead 35.

The remainder of the frame F2 has essentially the same construction as the frame F1 with the body 25 being adapted to be inserted into an opening 7' in a wall 8' to circumscribe the wall opening with the nailing fin 29 abutting the outer face 9' of the wall 8' and circumscribing the perimeter of the wall opening 7'.

The body portion 25 of the frame F2 has a window stop formation 36 corresponding to the window stop 11, a screen support seating section 37 corresponding to the screen support section 12 supporting a screen 38 and defining with the outwardly projecting portion 30 and the return portion 31 a chamber 39 which includes the trough 33.

As in the case of frame F1, the body portion 25 of frame F2 includes a channel 40 beneath stop ledges 41 and 42, a latch section 43 for receiving a snap-in inner stop 44 for retaining a window unit or sash 45 between the outer window stop formation 36 and the snap-in inner stop 44.

It will be noted that the snap-in stop 44 of the frame F2 has significantly less height than the snap-in stop 20 of the frame F1, FIG. 1. That is, the interior height of the sill of the frame F2 including the snap-in stop 44 at the sill is substantially less than the interior height of the frame F1 with its snap-in stop 20. This results not only in improving the interior appearance of the window but importantly increases the egress opening available on opening of the sash 45 of frame F2 over the egress opening available on opening the sash 15 of the frame F1.

As with frame F1, as viewed at the sill of the frame, the channel 40 beneath the closed sash 45 of frame F2 has an outlet opening 46 so that water forced against the sash in heavy rain storms will penetrate in the direction of the arrows 47 beneath the sash and into the chamber 39. However, in the case of the chamber 39, the water will drop into the trough 33 which, in turn, is provided with an outlet opening 48 at the bottom thereof.

In the example given, the depth of the trough 33 has been chosen to equal the reduction in height of the snap-in stop 44 of frame F2 from the height of the snap-in stop 20 of frame F1. As a result, frame F2 provides the same water resistance or dam height X as frame F1 while at the same time reducing the interior sill height of the frame and increasing the egress opening available on opening of the window.

It will be understood that the depth of the trough 33 and height of the snap-in stop 44 may be varied as desired depending upon the desired water resistance and other details of the frame may be changed without departing from the scope of the appended claims.

Although various preferred embodiments of the present invention have been described herein in detail, it will be appreciated by those skilled in the art, that variations may be made thereto without departing from the scope of the appended claims.

The Embodiments of the Invention In Which an Exclusive Property or Privilege is Claimed are Defined as Follows:

1. A window frame having a body portion to be received in a window opening, said body portion being adapted for receiving and supporting a slideable window sash, said body portion having an integral J-rail return member comprising a nailing fin portion, a projecting portion extending outwardly away from said nailing fin portion, and a return portion connected to the outer end of said projecting portion defining a J-channel to receive siding, said J-rail member return portion having a double wall providing at the bottom of said frame body portion a trough depending from the end of said J-rail return projecting portion, a wall formation connected between said frame body portion and said J-rail return member forming a chamber including at the bottom of said body portion said depending trough, an outlet from the bottom of said body portion into said chamber, and an outlet adjacent the bottom of said trough to the exterior of said frame.

2. A window unit as claimed in claim 1 in which said wall formation comprises an outer sash stop.

3. A window unit as claimed in claim 2 in which said body portion is provided at the side opposite said outer sash stop with a latching section to receive a snap-in inner sash stop.

4. A window unit as claimed in claims 1, 2 or 3 in which said wall formation forms a support for a screen.

5. A window frame for mounting in a rectangular opening in a wall of a structure said window frame having a rectangular body portion for insertion into the window opening to circumscribe the interior thereof and including a sill portion, said body portion having means to support a slideable window sash and having an integral J-rail return member, said J-rail return member having a nailing fin portion projecting perpendicularly outwardly from said body portion to circumscribe the wall of the structure around the window opening, a projecting portion connected to said nailing fin portion and projecting outwardly therefrom, and a return portion extending outwardly from said projecting portion in the direction of and generally parallel to said nailing fin portion to provide a J-channel to receive siding, said return portion of said J-rail return member having a double walled section defining at the sill of the frame a depending trough disposed at the end of said projecting portion and a single wall section projecting from the bottom of said trough section, said frame body portion having an integral outer window stop formation joined with said integral J-rail return member to form at the sill of said frame a chamber overlying said J-rail return member and including said trough, a drain outlet from the bottom of said frame body portion into said chamber and a drain outlet from said chamber adjacent the bottom of said trough.

6. A window frame as claimed in claim 5 in which said body portion is formed with a channel to surround a sash when same is mounted in said frame and said drain outlet from the body of said frame body portion connects said channel to said chamber.

7. A window frame as claimed in claims 5 or 6 in which said outer window stop formation is provided with means to support a screen.

8. A frame as claimed in claims 5 or 6 in which said frame body portion is formed on the inner side thereof with a latch section adapted to receive a snap-in inner window stop.

9. A window frame having a body portion to be received in a window opening, said body portion being adapted for receiving and supporting a slideable window sash, said body portion being provided at the bottom with a sash closing stop above a channel and having at the outer side an integral J-rail return member at the bottom of said channel, said J-rail return member comprising a nailing fin portion, a projecting portion, and a return portion defining a J-channel to receive siding, said J-rail member return portion having a double wall providing at the bottom of said frame body portion a trough depending from the end of said J-rail return projecting portion, a wall formation connected between said frame body portion and said J-rail return member forming a chamber including said depending trough, an outlet from the bottom of said channel into said chamber, and an outlet adjacent the bottom of said trough to the exterior of said frame, said wall formation forming an outer sash stop, said body portion further having at the inner side a latching section to receive a snap-in inner sash stop.

* * * * *